US011101538B2

(12) United States Patent
Xu et al.

(10) Patent No.: US 11,101,538 B2
(45) Date of Patent: Aug. 24, 2021

(54) MODULAR DEPLOYABLE ANTENNA MECHANISM BASED ON SYMMETRICALLY STRUCTURAL TETRAHEDRON COMBINATION UNIT

(71) Applicant: Yanshan University, Qinhuangdao (CN)

(72) Inventors: Yundou Xu, Qinhuangdao (CN); Luyao Guo, Qinhuangdao (CN); Jinwei Guo, Qinhuangdao (CN); Yang Chen, Qinhuangdao (CN); Jiantao Yao, Qinhuangdao (CN); Yongsheng Zhao, Qinhuangdao (CN)

(73) Assignee: Yanshan University

( * ) Notice: Subject to any disclaimer, the term of this patent is extended or adjusted under 35 U.S.C. 154(b) by 23 days.

(21) Appl. No.: 16/701,696

(22) Filed: Dec. 3, 2019

(65) Prior Publication Data

US 2020/0203799 A1 Jun. 25, 2020

(30) Foreign Application Priority Data

Dec. 19, 2018 (CN) ..... 201811556043.2

(51) Int. Cl.
*H01Q 15/16* (2006.01)
*H01Q 1/12* (2006.01)
*H01Q 1/24* (2006.01)

(52) U.S. Cl.
CPC ..... *H01Q 1/1235* (2013.01); *H01Q 1/24* (2013.01)

(58) Field of Classification Search
CPC ..... H01Q 1/1235; H01Q 1/08; H01Q 1/246; H01Q 15/161; H01Q 1/288; H01Q 21/28;
(Continued)

(56) References Cited

U.S. PATENT DOCUMENTS 3,241,142 A * 3/1966 Raabe ..... H01Q 1/081 342/355
4,558,551 A * 12/1985 Sevelinge ..... F24S 23/71 52/646

(Continued)

FOREIGN PATENT DOCUMENTS

CN 102173312 A 9/2011
CN 102285463 A 12/2011

(Continued)

OTHER PUBLICATIONS

Supplemental Search Report for Chinese Application No. 201811556043.2 dated Oct. 28, 2019; 1 page.

(Continued)

*Primary Examiner* — Linh V Nguyen
(74) *Attorney, Agent, or Firm* — Lerner, David, Littenberg, Krumholz & Mentlik, LLP

(57) ABSTRACT

The present invention discloses a modular deployable antenna mechanism based on a symmetrically structural tetrahedron combination unit. The deployable antenna mechanism is formed by multiple deployable antenna modules, two adjacent deployable antenna modules are connected through a first face plate at the bottom of one deployable antenna module and a second face plate at the bottom of the other deployable antenna module, the first face plate and the second face plate are connected through a Hooke joint, an unconnected first face plate and second face plate of the two adjacent deployable antenna modules are connected through a first synchronizing bar, a middle portion of a bar body of the first synchronizing bar can be folded, and the first synchronizing bar is rotationally connected with the first face plate and the second face plate.

5 Claims, 7 Drawing Sheets

(58) Field of Classification Search
CPC ..... H01Q 1/273; H01Q 1/125; H01Q 1/084; H01Q 1/10; B64G 1/222; B64G 1/66; B64G 2700/66; B64G 9/00; B64G 1/10; B64G 1/244; B64G 1/283; B64G 1/285; B64G 1/288; B64G 1/34; B64G 1/36; B64G 1/363; B64G 1/365; B64G 1/44
USPC ..... 343/879
See application file for complete search history.

(56) References Cited

U.S. PATENT DOCUMENTS

| | | | | |
|---|---|---|---|---|
| 8,615,960 | B2 * | 12/2013 | Marcotte | E21B 15/00 52/655.1 |
| 9,496,621 | B2 * | 11/2016 | Meschini | H01Q 15/161 |
| 2002/0063660 | A1 * | 5/2002 | Harless | H01Q 15/161 343/915 |
| 2010/0139202 | A1 * | 6/2010 | Athan | E04B 1/3211 52/655.1 |
| 2019/0280392 | A1 * | 9/2019 | Wilde | H01Q 1/125 |
| 2020/0006838 | A1 * | 1/2020 | Reveles-Wilson | H01Q 15/161 |
| 2020/0067168 | A1 * | 2/2020 | Harless | E04B 1/19 |

FOREIGN PATENT DOCUMENTS

| | | | |
|---|---|---|---|
| CN | 107685880 | A | 2/2018 |
| JP | H02283598 | A | 11/1990 |
| RU | 2011132996 | A | 2/2013 |

OTHER PUBLICATIONS

First Search Report for Chinese Application No. 201811556043.2 dated Sep. 19, 2019; 1 page.

* cited by examiner

MODULAR DEPLOYABLE ANTENNA MECHANISM BASED ON SYMMETRICALLY STRUCTURAL TETRAHEDRON COMBINATION UNIT

CROSS REFERENCE TO RELATED APPLICATIONS

This application claims priority from Chinese application number 201811556043.2, filed Dec. 19, 2018, the disclosure of which is hereby incorporated herein by reference.

TECHNICAL FIELD

The present invention relates to the technical field of spatial deployable mechanisms, and in particular, to a modular deployable antenna mechanism based on a symmetrically structural tetrahedron combination unit.

BACKGROUND

Space technology plays an important role in the strategic science and technology development plan in China, and with implementation and deep research of a series of key space science and technology engineering such as deep space exploration, manned space flight, large launch vehicle and the like, application requirements on a large deployable mechanism are more urgent. Recently, the large deployable mechanism is widely applied to space missions such as a deployable mast, an antenna, a solar panel and the like due to its own excellent performances such as consistency and repeatability of a structural geometric unit, high-rigidity and flexible geometric design characteristics, high surface accuracy and the like.

Research on a deployable mechanism has become an international research hotspot nowadays. Domestic and international numerous research scholars and institutions have deeply studied a deployable antenna mechanism, and multiple large deployable mechanism having various structures and performances appear one after another, typically including a sunflower deployable antenna researched by TRW Inc., a folding articulated square truss (FAST) deployable mast developed by AEC-Able engineering company Inc. for International Space Station, and an EGS antenna developed by Russia Energia-GPI Space joint company. Research of a space deployable mechanism starts later in China, and even though some research achievements have been obtained, the existing mechanisms to be successfully developed and smoothly applied are less, and multiple deployable antenna mechanisms have many limitations in actual application. Currently, research of the deployable mechanism mainly focuses on kinematics and dynamics of the mechanism, the types of the existing deployable antenna mechanisms having excellent performance are less, a connection form between units is single, and the types of components are more, so, not only processing and manufacturing costs are high, but also mounting difficulty is high. It is lack of a modular space deployable antenna mechanism formed by units having the same structures, and a modular design can reduce the processing and manufacturing costs and the mounting difficulty and can form any apertures of large deployable antenna mechanisms. To meet the requirements of the current space science mission on a large-aperture antenna, it is of important research significance and practical value to design a new modular space deployable mechanism.

SUMMARY

An objective of the present invention is to provide a modular deployable antenna mechanism based on a symmetrically structural tetrahedron combination unit, which has the advantages of simple structure, low processing and manufacturing costs and low mounting difficulty and can form any apertures of large deployable antenna mechanisms having a high folding rate, in order to solve problems in the prior art.

To achieve the above purpose, the present invention provides the following technical solution.

The present invention provides a modular deployable antenna mechanism based on a symmetrically structural tetrahedron combination unit, where the deployable antenna mechanism is formed by multiple deployable antenna modules, two adjacent deployable antenna modules are connected through a first face plate at the bottom of one deployable antenna module and a second face plate at the bottom of the other deployable antenna module, the first face plate and the second face plate are connected through a Hooke's joint, an unconnected first face plate and second face plate of the two adjacent deployable antenna modules are connected through a first synchronizing bar, a middle portion of a bar body of the first synchronizing bar can be folded, and the first synchronizing bar is rotationally connected with the first face plate and the second face plate.

Preferably, the Hooke's joint includes a connecting groove, a T-shaped sleeve, a connecting rod and pins, the connecting groove is arranged in the first face plate, the connecting rod is arranged at the second face plate, two ends of a cross bar of the T-shaped sleeve are rotationally connected with two side walls of the connecting groove through a pin inserted in the cross bar, a vertical bar of the T-shaped sleeve is rotationally connected with the connecting rod through a pin inserted in the vertical bar, an axis of the cross bar of the T-shaped sleeve is in parallel with an axis of a first synchronizing bar adjacent to the cross bar, and an axis of the vertical bar of the T-shaped sleeve is vertical to a plane on which multiple first synchronizing bars are located.

Preferably, the deployable antenna module is formed by three tetrahedral deployable antenna units;

the tetrahedral deployable antenna unit includes four face plates, three equal-length web members and three second synchronizing bars; the four face plates include the first face plate, the second face plate, a third face plate and a fourth face plate, and the fourth face plate is arranged at the top of the first face plate, the second face plate and the third face plate; the fourth face is respectively connected with the first face plate, the second face plate and the third face plate through a web member, and two ends of each web member are rotationally connected with the first face plate, the second face plate, the third face plate and the fourth face plate; the first face plate, the second face plate and the third face plate are sequentially connected through three second synchronizing bars, a middle portion of a bar body of the second synchronizing bar can be vertically folded, and the second synchronizing bars are rotationally connected with the first face plate, the second face plate and the third face plate; and the web members connected with the third face plates of the three tetrahedral deployable antenna units share one third face plate, and the second synchronizing bars connected with the third face plates of the three tetrahedral deployable antenna units also share one third face plate; the fourth face plates of the three tetrahedral deployable antenna units are connected through three third synchronizing bars, a middle portion of a bar body of the third synchronizing bar can be folded, and the third synchronizing bar is rotationally connected with the first face plate; the first face plates and the second face plates of the adjacent tetrahedral deployable antenna units are connected through the fourth synchronizing bars to form a closed loop, a middle portion of a bar body of the fourth synchronizing bar can be folded, and the fourth synchronizing bar is rotationally connected with the first face plate and the second face plate; and the first face plates, the second face plates and the shared third face plate of the three tetrahedral deployable antenna units are located on the same plane, and connecting lines of the centers of the first face plates and the centers of the second face plates of the three tetrahedral deployable antenna units form a regular hexagon.

Preferably, annular grooves are arranged in end faces of connecting ends of the web members and the first face plate, the second face plate, the third face plate and the fourth face plate, an inner side wall and an outer side wall of the annular groove are circumferentially provided with multiple paired hinging holes, and end portions of the web members are hinged with the hinging holes through pins.

Preferably, the middle portions of the bar bodies of the first synchronizing bar, the second synchronizing bar, the third synchronizing bar and the fourth synchronizing bar are connected through synchronous hinges.

Preferably, outer circumferences of the first face plate, the second face plate, the third face plate and the fourth face plate are provided with multiple paired first parallel tabs, end portions of the first synchronizing bar, the second synchronizing bar, the third synchronizing bar and the fourth synchronizing bar are provided with second parallel tabs matching with the first parallel tabs, the second parallel tab extends into the first parallel tab and is hinged by a pin, and an axis of the pin is in parallel with an axis of a revolute joint of the synchronous hinge.

Compared with the prior art, the present invention has the following beneficial effects:

1. according to the modular deployable antenna mechanism based on a symmetrically structural tetrahedron combination unit provided by the present invention, a connection manner of components of a combination units is simple so as to be easy to achieve a design of a high-rigidity structure; and 2. according to the modular deployable antenna mechanism based on a symmetrically structural tetrahedron combination unit provided by the present invention, all modules are completely the same so as to be conveniently processed, manufactured and assembled; any apertures of large deployable antenna mechanisms with a high folding rate can be formed by designing the size and the number of the modules, so expandability is strong; and the modules are connected through Hooke's joints such that relative posture adjustment of the modules can be achieved, the antenna mechanism can be finally completely folded (where postures of face plates are consistent and all connecting rods are tightly closed), and the folding rate is high.

BRIEF DESCRIPTION OF THE DRAWINGS

To describe the technical solutions in the embodiments of the present invention or in the prior art more clearly, the following briefly introduces the accompanying drawings required for describing the embodiments. Apparently, the accompanying drawings in the following description show merely some embodiments of the present invention, and a person of ordinary skill in the art may still derive other accompanying drawings from these accompanying drawings without creative efforts.

In the figure, 1—first face plate, 2—second face plate, 3—third face plate, 4—fourth face plate, 5—web member, 6—first synchronizing bar, 7—synchronous hinge, 8—second synchronizing bar, 9—third synchronizing bar, 10—fourth synchronizing bar, 11—annular groove, 12—first parallel tab, 13—second parallel tab, 14—connecting groove, 15—T—shaped sleeve, 16—connecting rod, C-axis of a cross bar of a T-shaped sleeve, D-axis of a vertical bar of a T-shaped sleeve, 21—synchronous gear, 22—torsion spring, 23—frame, I—first deployable antenna module, II—second deployable antenna module, and III—third deployable antenna module.

DETAILED DESCRIPTION

The following clearly and completely describes the technical solutions in the embodiments of the present invention with reference to accompanying drawings in the embodiments of the present invention. Apparently, the described embodiments are merely a part rather than all of the embodiments of the present invention. All other embodiments obtained by a person of ordinary skill in the art based on the embodiments of the present invention without creative efforts shall fall within the protection scope of the present invention.

An objective of the present invention is to provide a modular deployable antenna mechanism based on a symmetrically structural tetrahedron combination unit to solve problems in the prior art.

To make the foregoing objective, features, and advantages of the present invention clearer and more comprehensible, the present invention is further described in detail below with reference to the accompanying drawings and specific embodiments.

Embodiment 1

Figure 1:
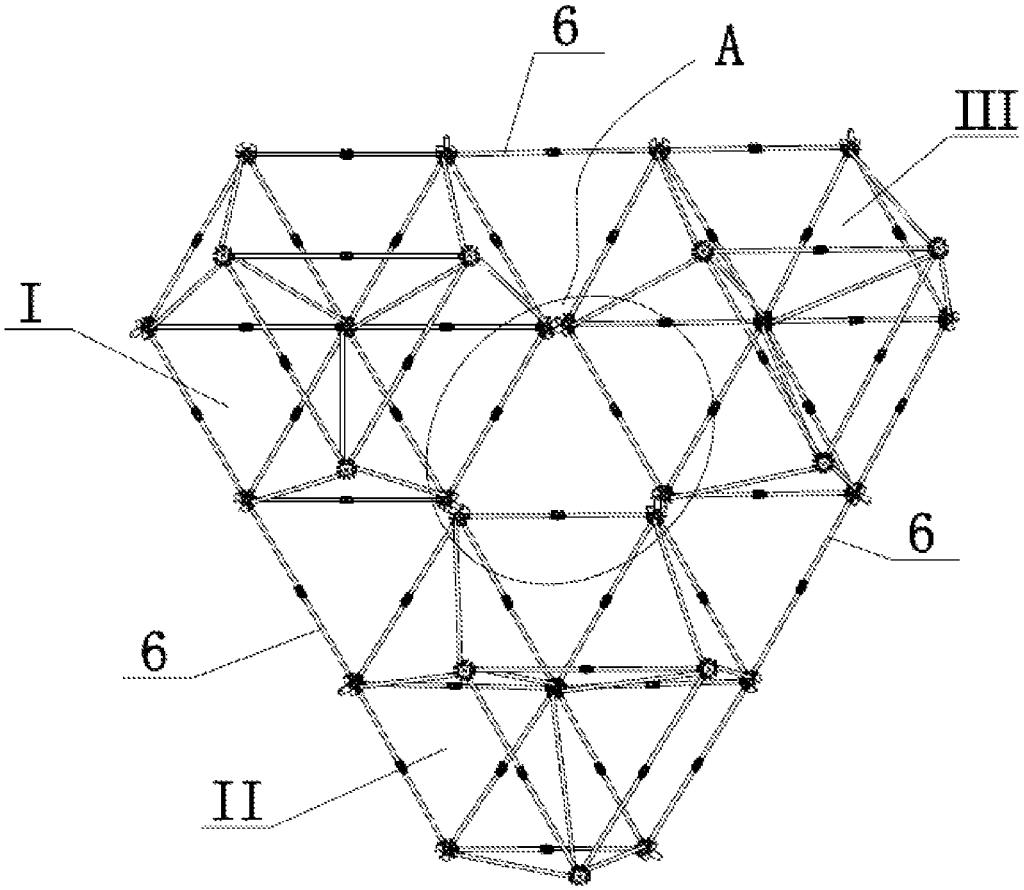
FIG. 1 is a top view of a stereo structure of a deployable antenna mechanism in a completely unfolding state in the present invention.
Figure 2:
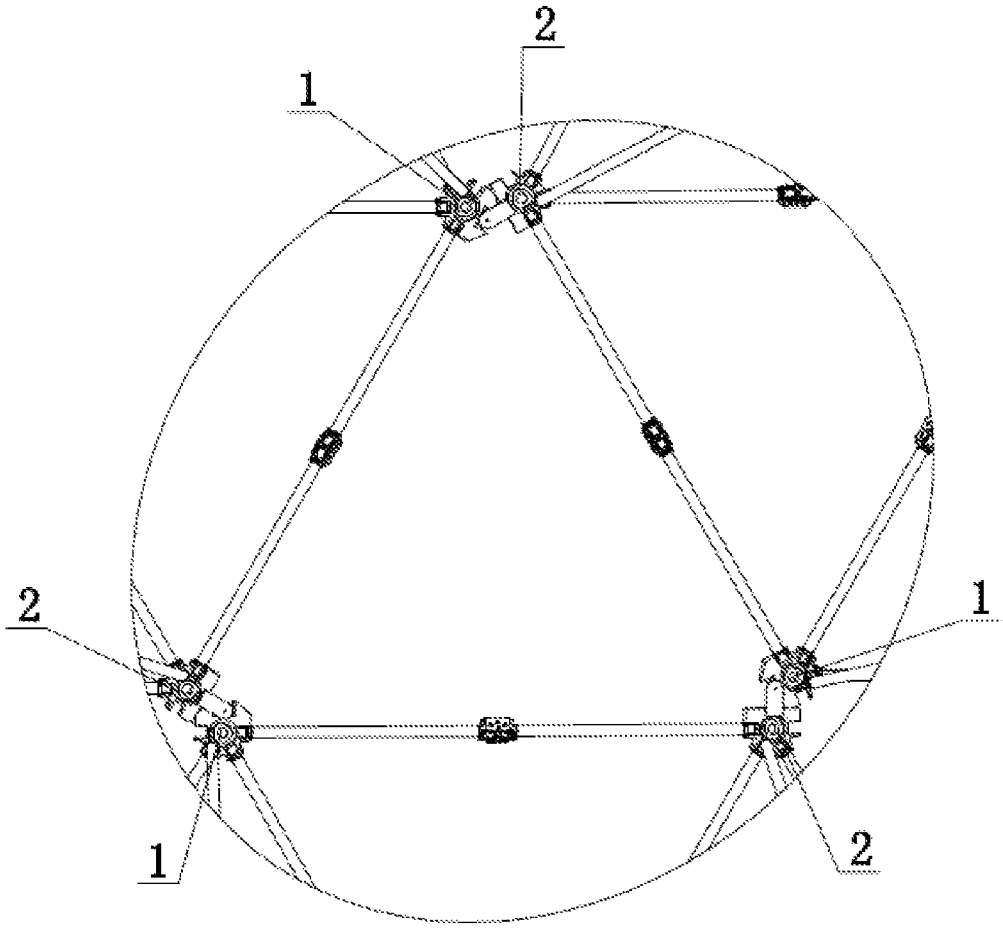
FIG. 2 is an enlarged partial diagram of a part A in FIG. 1.

The embodiment provides a modular deployable antenna mechanism based on a symmetrically structural tetrahedron combination unit, as shown in FIG. 1 and FIG. 2, the deployable antenna mechanism is formed by multiple deployable antenna modules, two adjacent deployable antenna modules are connected through a first face plate 1 at the bottom of one deployable antenna module and a second face plate 2 at the bottom of the other deployable antenna module, the first face plate 1 and the second face plate 2 are connected through a Hooke's joint, an unconnected first face plate 1 and second face plate 2 of the two adjacent deployable antenna modules are connected through a first synchronizing bar 6, a middle portion of a bar body of the first synchronizing bar 6 can be folded, and the first synchronizing bar 6 is rotationally connected with the first face plate 1 and the second face plate 2.

Figure 3:
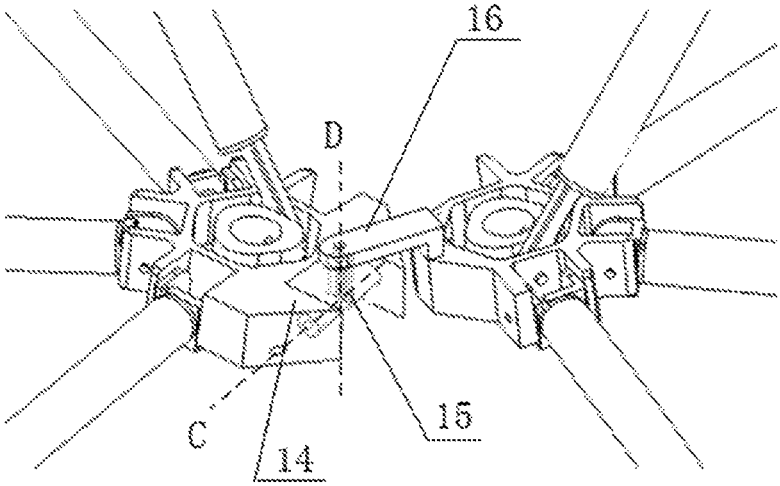
FIG. 3 is a schematic structural diagram of a Hooke's joint in the present invention.

In the specific embodiment, as shown in FIG. 3, the Hooke's joint includes a connecting groove 14, a T-shaped sleeve 15, a connecting rod 16 and pins, the connecting groove 14 is arranged in the first face plate 1, the connecting rod 16 is arranged at the second face plate 2, two ends of a cross bar of the T-shaped sleeve 15 are rotationally connected with two side walls of the connecting groove 14 through a pin inserted in the cross bar, a vertical bar of the T-shaped sleeve 15 is rotationally connected with the connecting rod 16 through a pin inserted in the vertical bar, an axis C of the cross bar of the T-shaped sleeve 15 is in parallel with an axis of a first synchronizing bar 6 adjacent to the cross bar, and an axis D of the vertical bar of the T-shaped sleeve 15 is vertical to a plane on which multiple first synchronizing bars 6 are located.

In the specific embodiment, the deployable antenna mechanism is formed by three deployable antenna modules, as shown in FIG. 1 and FIG. 2, the three deployable antenna modules respectively are a first deployable antenna module I, a second deployable antenna module II and a third deployable antenna module III, and one first face plate 1 of the first deployable antenna module I is hinged with one second face plate 2 of the third deployable antenna module III through a Hooke's joint; and one first face plate 1 of the third deployable antenna module III is hinged with one second face plate 2 of the second deployable antenna module II through a Hooke's joint, and one first face plate 1 of the second deployable antenna module II is hinged with one second face plate 2 of the first deployable antenna module I through a Hooke's joint, thereby achieving connection of the face plates at the bottoms of the three deployable antenna modules.

A plane of equilateral triangle can be formed by utilizing axes of the first synchronizing bars 6 connected among the three deployable antenna modules as sides; the axis C of the cross bar of the T-shaped sleeve 15 is in parallel with the side of one equilateral triangle adjacent to the cross bar, the axis D of the vertical bar of the T-shaped sleeve 15 is vertical to the plane, on which the equilateral triangle is located, and the modules can swing around the two axes to achieve posture adjustment of the modules.

Figure 4:
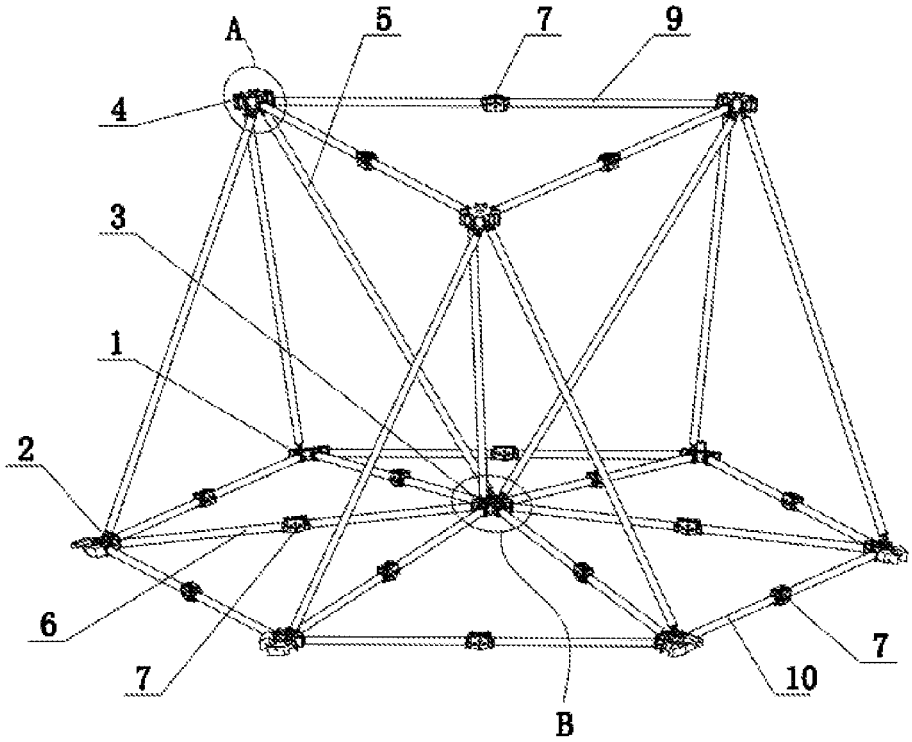
FIG. 4 is a schematic diagram of a stereo structure of a deployable antenna module in the present invention.
Figure 5:
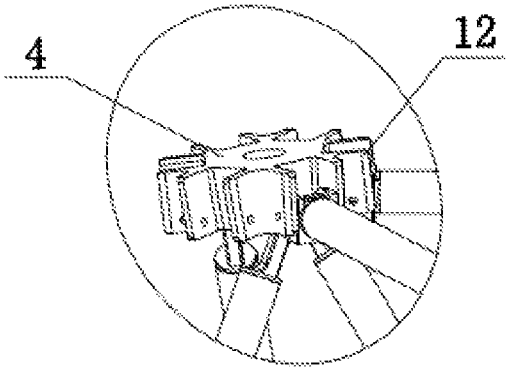
FIG. 5 is an enlarged partial diagram of a part A in FIG. 4.
Figure 6:
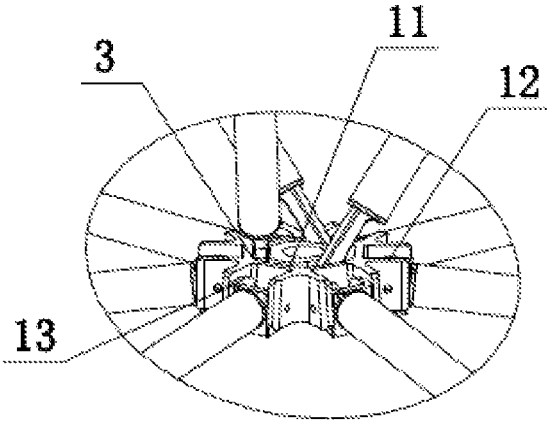
FIG. 6 is an enlarged partial diagram of a part B in FIG. 4.

As shown in FIG. 4 to FIG. 6, in the embodiment, the deployable antenna module is formed by three tetrahedral deployable antenna units;

the tetrahedral deployable antenna unit includes four face plates, three equal-length web members 5 and three second synchronizing bars 8; the four face plates include the first face plate 1, the second face plate 2, a third face plate 3 and a fourth face plate 4, and the fourth face plate 4 is arranged at the top of the first face plate 1, the second face plate 2 and the third face plate 3; the fourth face 4 is respectively connected with the first face plate 1, the second face plate 2 and the third face plate 3 through a web member 5, and two ends of each web member 5 are rotationally connected with the first face plate 1, the second face plate 2, the third face plate 3 and the fourth face plate 4; the first face plate 1, the second face plate 2 and the third face plate 3 are sequentially connected through three second synchronizing bars 8, a middle portion of a bar body of the second synchronizing bar 8 can be vertically folded, and the second synchronizing bars 8 are rotationally connected with the first face plate 1, the second face plate 2 and the third face plate 3; and the web members 5 connected with the third face plates 3 of the three tetrahedral deployable antenna units share one third face plate 3, and the second synchronizing bars 8 connected with the third face plates 3 of the three tetrahedral deployable antenna units also share one third face plate 3; the fourth face plates 4 of the three tetrahedral deployable antenna units are connected through three third synchronizing bars 9, a middle portion of a bar body of the third synchronizing bar 9 can be folded, and the third synchronizing bar 9 is rotationally connected with the first face plate 1; the first face plates 1 and the second face plates 2 of the adjacent tetrahedral deployable antenna units are connected through the fourth synchronizing bars 10 to form a closed loop, a middle portion of a bar body of the fourth synchronizing bar 10 can be folded, and the fourth synchronizing bar 10 is rotationally connected with the first face plate 1 and the second face plate 2; and the first face plates 1, the second face plates 2 and the shared third face plate 3 of the three tetrahedral deployable antenna units are located on the same plane, and connecting lines of the centers of the first face plates 1 and the centers of the second face plates 2 of the three tetrahedral deployable antenna units form a regular hexagon.

Figure 7:
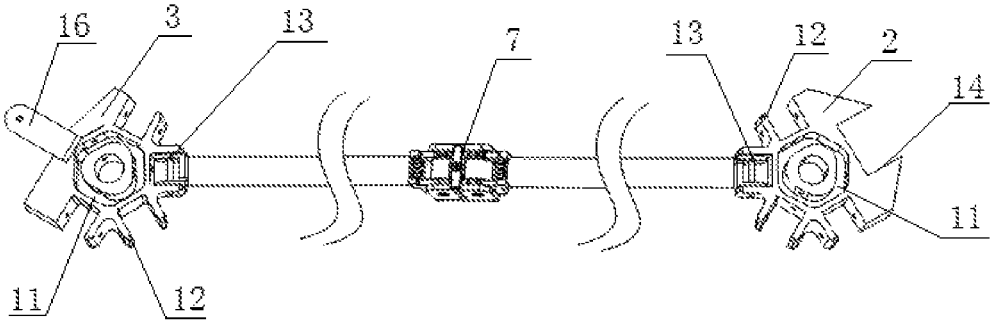
FIG. 7 is a schematic structural diagram of a first face plate and a second face plate, which are connected with a second synchronizing bar, in the present invention.
Figure 8:
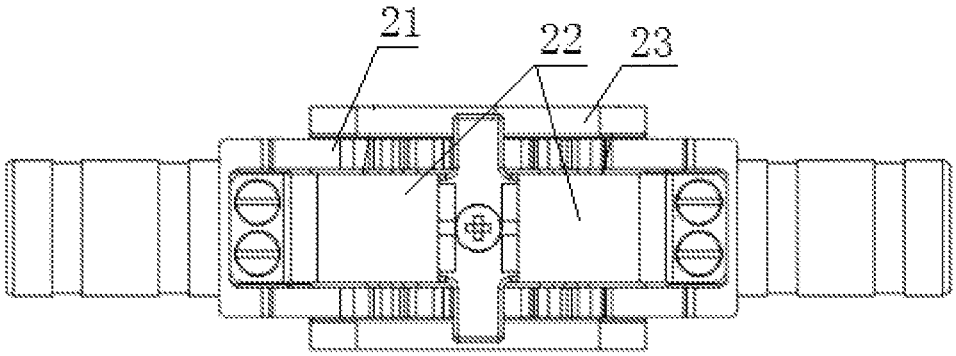
FIG. 8 is a top view of a synchronous hinge in an unfolding state in the present invention.
Figure 9:
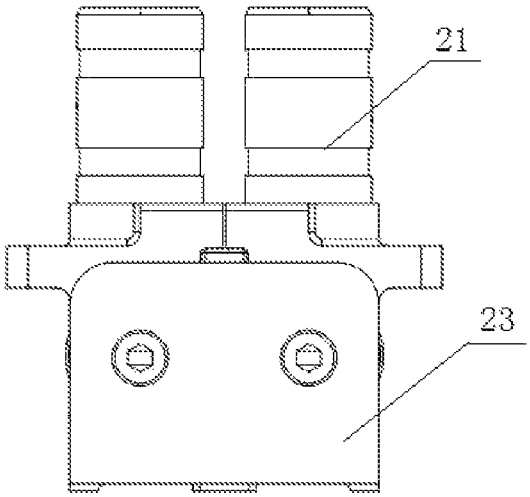
FIG. 9 is a front view of a synchronous hinge in a completely folding state in the present invention.
Figure 10:
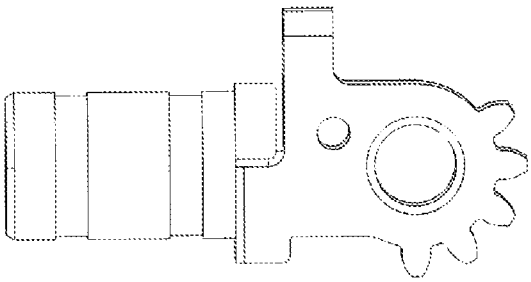
FIG. 10 is a front view of a synchronous gear in the present invention.
Figure 11:
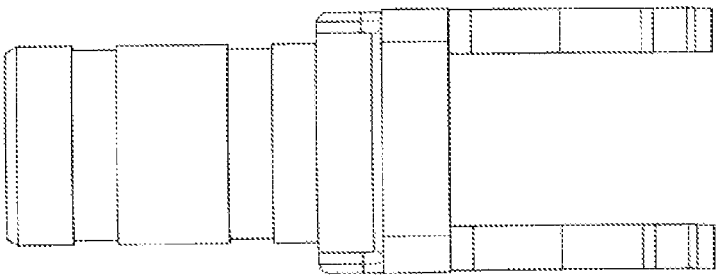
FIG. 11 is a top view of a synchronous gear in the present invention.
Figure 12:
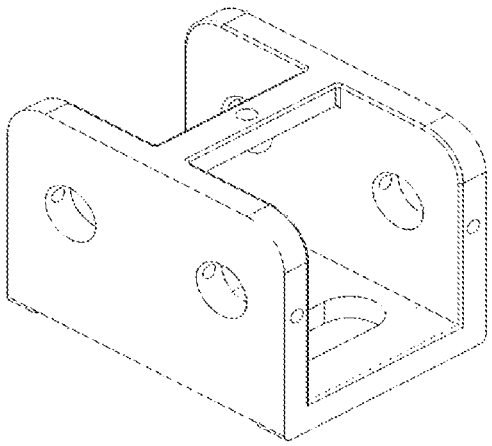
FIG. 12 is a schematic diagram of a stereo structure of a frame in the present invention.
Figure 13:
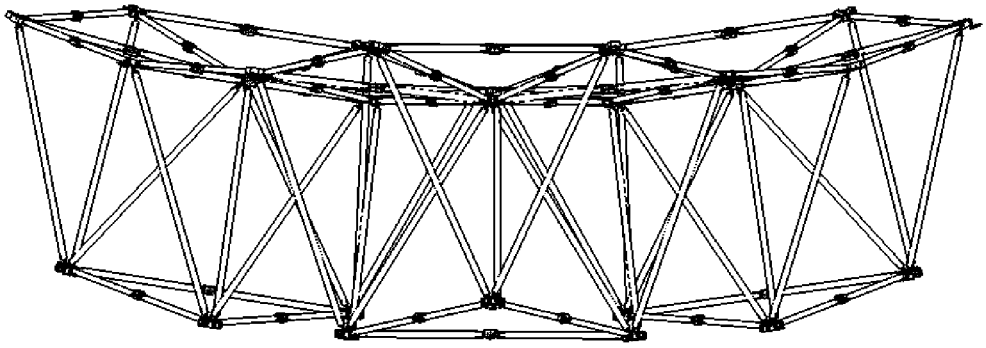
FIG. 13 is a front view of a stereo structure of a deployable antenna mechanism in a completely unfolding state in the present invention.
Figure 14:
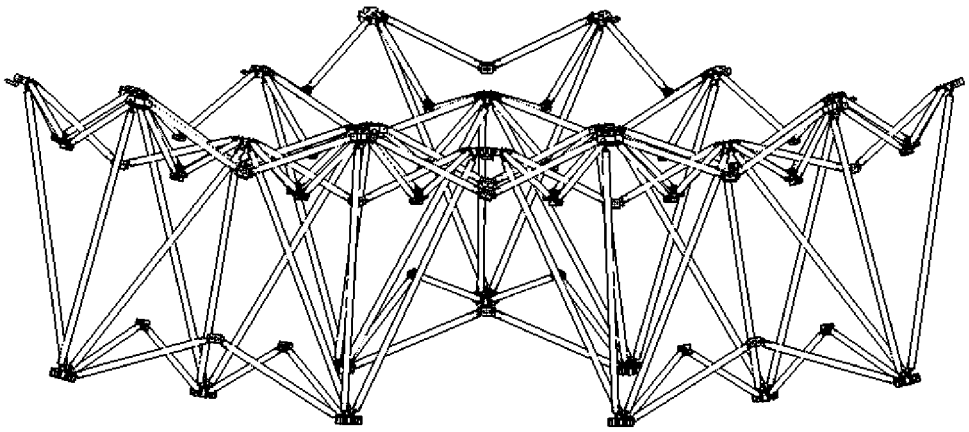
FIG. 14 is a schematic diagram of a stereo structure of a deployable antenna mechanism in a half folding state in the present invention.
Figure 15:
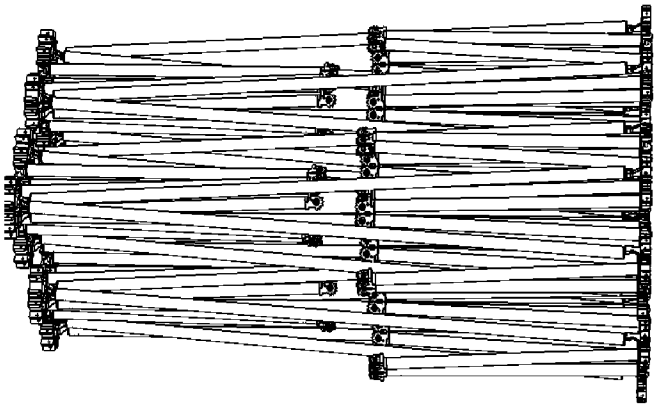
FIG. 15 is a schematic diagram of a stereo structure of a deployable antenna mechanism in a completely folding state in the present invention.

As shown in FIG. 6 and FIG. 7, to achieve rotational connection of the web members 5 and the face plates, annular grooves 11 are arranged in end faces of connecting ends of the web members 5 and the first face plate 1, the second face plate 2, the third face plate 3 and the fourth face plate 4, an inner side wall and an outer side wall of the annular groove 11 are circumferentially provided with multiple paired hinging holes, and the end portions of the web members 5 are hinged with the hinging holes through pins; the specific number of pairs of the hinging holes is the same with the number of the connected web members 5, and the fourth face plate 4 is synchronously connected with three web members 5 such that three pairs of the hinging holes are uniformly distributed on the outer side wall and the inner side wall of the annular groove 11 of the fourth face plate 4.

In the specific embodiment, the middle portions of the bar bodies of the first synchronizing bar 6, the second synchronizing bar 8, the third synchronizing bar 9 and the fourth synchronizing bar 10 are connected through synchronous hinges 7.

As shown in FIG. 8 to FIG. 12, a specific structure of the synchronous hinge 7 arranged at the middle portion of each synchronizing bar is combined by synchronous gears 21, torsion springs 22 and a frame 23, the two relative synchronous gears 21 are connected with two sides of the interior of the frame 23 through pins, the torsion springs 22 are located between the synchronous gears 21, and the two synchronous gears 21 are engaged to achieve rotation between the synchronizing bars and form a revolute joint. The frame 23 exerts supporting and protecting functions, one end of the frame 23 is opened and can achieve complete folding while the other end thereof is closed and can achieve a limiting function when the synchronizing bar is completely unfolded (namely opens by 180 degrees).

In the embodiment, as shown in FIG. 7, outer circumferences of the first face plate 1, the second face plate 2, the third face plate 3 and the fourth face plate 4 are provided with multiple paired first parallel tabs 12 (the number of the pairs of the parallel tabs is the same with the number of the synchronizing bars connected with the face plates), the end portions of the first synchronizing bar 6, the second synchronizing bar 8, the third synchronizing bar 9 and the fourth synchronizing bar 10 are provided with second parallel tabs 13 matching with the first parallel tabs 12, the second parallel tab 13 extends into the first parallel tab 12 and is hinged by a pin, and an axis of the pin is in parallel with an axis of a revolute joint of the synchronous hinge 7 on the synchronizing bar, at which the second parallel tab 13 is located.

The modular deployable antenna mechanism based on a symmetrically structural tetrahedron combination unit provided by the present invention adds reasonable drive to the revolute joint of the middle portion of each synchronizing bar such that each module can achieve folding and posture adjusting so as to achieve complete folding of the whole module mechanism, and at this time, face plate planes are basically consistent and horizontal, the bars are closed to each other to form a minimum closing volume, and FIG. 1, FIG. 13, FIG. 14 and FIG. 15 are schematic structural diagrams of the deployable antenna in an unfolding state, a half folding state and a completely folding state in different perspective views.

Several examples are used for illustration of the principles and implementation methods of the present invention. The description of the embodiments is used to help illustrate the method and its core principles of the present invention. In addition, those skilled in the art can make various modifications in terms of specific embodiments and scope of application in accordance with the teachings of the present invention. In conclusion, the content of this specification shall not be construed as a limitation to the present invention.

What is claimed is:

1. A modular deployable antenna mechanism based on a symmetrically structural tetrahedron combination unit, wherein the deployable antenna mechanism is formed by multiple deployable antenna modules, two adjacent deployable antenna modules are connected through a first face plate at the bottom of one deployable antenna module and a second face plate at the bottom of the other deployable antenna module, the first face plate and the second face plate are connected through a Hooke's joint, an unconnected first face plate and second face plate of the two adjacent deployable antenna modules are connected through a first synchronizing bar, a middle portion of a bar body of the first synchronizing bar can be folded, and the first synchronizing bar is rotationally connected with the first face plate and the second face plate;

the deployable antenna module is formed by a three tetrahedral deployable antenna units; the tetrahedral deployable antenna unit comprises four face plates, three equal-length web members, two second synchronizing bars, and one fourth synchronizing bar; the four face plates comprise the first face plate, the second face plate, a third face plate and a fourth face plate, and the fourth face plate is arranged at the top of the first face plate, the second face plate and the third face plate; the fourth face plate is respectively connected with the first face plate, the second face plate and the third face plate through a web member, and two ends of each web member are rotationally connected with the first face plate, the second face plate, the third face plate and the fourth face plate; the first face plate is connected to the third face plate through the second synchronizing bar, the second face plate is connected to the third face plate through the second synchronizing bar, and the first face plate is connected to the second face plate through the fourth synchronizing bar; middle portions of bar bodies of the second synchronizing bar and the fourth synchronizing bar each can be vertically folded; the second synchronizing bars are rotationally connected with the first face plate, the second face plate and the third face plate, and the fourth synchronizing bar is also rotationally connected with the first face plate and the second face plate;

the web members connected with the third face plates of the three tetrahedral deployable antenna units share one third face plate, and the second synchronizing bars connected with the third face plates of the three tetrahedral deployable antenna units also share one third face plate; the fourth face plates of the three tetrahedral deployable antenna units are connected through three third synchronizing bars, a middle portion of a bar body of the third synchronizing bar can be folded, and the third synchronizing bar is rotationally connected with the fourth face plate; the first face plates and the second face plates of the adjacent tetrahedral deployable antenna units are connected through the fourth synchronizing bars to form a closed loop, and the fourth synchronizing bar is rotationally connected with the first face plate and the second face plate; connecting lines of the centers of the first face plates and the centers of the second face plates of the three tetrahedral deployable antenna units form a regular hexagon; wherein the Hooke's joint comprises a connecting groove, a T-shaped sleeve, a connecting rod and pins, the connecting groove is arranged in the first face plate, the connecting rod is arranged at the second face plate, two ends of a cross bar of the T-shaped sleeve are rotationally connected with two side walls of the connecting groove through a pin inserted in the cross bar, and a vertical bar of the T-shaped sleeve is rotationally connected with the connecting rod through a pin inserted in the vertical bar.

2. The modular deployable antenna mechanism based on a symmetrically structural tetrahedron combination unit according to claim 1, wherein annular grooves are arranged in end faces of connecting ends of the web members and the first face plate, the second face plate, the third face plate and the fourth face plate, an inner side wall and an outer side wall of the annular groove are circumferentially provided with multiple paired hinging holes, and end portions of the web members are hinged with the hinging holes through pins.

3. The modular deployable antenna mechanism based on a symmetrically structural tetrahedron combination unit according to claim 2, wherein the middle portions of the bar bodies of the first synchronizing bar, the second synchronizing bar, the third synchronizing bar and the fourth synchronizing bar are connected through synchronous hinges.

4. The modular deployable antenna mechanism based on a symmetrically structural tetrahedron combination unit according to claim 3, wherein outer circumferences of the first face plate, the second face plate, the third face plate and the fourth face plate are provided with multiple paired first parallel tabs, end portions of the first synchronizing bar, the second synchronizing bar, the third synchronizing bar and the fourth synchronizing bar are provided with second parallel tabs matching with the first parallel tabs, the second parallel tab extends into the first parallel tab and is hinged by a pin, and an axis of the pin is in parallel with an axis of a revolute joint of the synchronous hinge; the second parallel tab is arranged on a swivel joint, and the swivel joint is rotationally connected with two ends of the bar bodies of each of the first synchronizing bar, the second synchronizing bar, the third synchronizing bar, and the fourth synchronizing bar.

5. The modular deployable antenna mechanism based on a symmetrically structural tetrahedron combination unit according to claim 4, wherein one end of the swivel joint is integrally connected with the second parallel tab, an inserting shaft is integrally arranged in the other end of the swivel joint, and the inserting shaft is inserted into the two ends of the bar bodies of each of the first synchronizing bar, the second synchronizing bar, the third synchronizing bar, and the fourth synchronizing bar.

* * * * *